US011793283B1

(12) United States Patent
Zhang

(10) Patent No.: US 11,793,283 B1
(45) Date of Patent: Oct. 24, 2023

(54) CARD HOLDER

(71) Applicant: Shenzhen Jiangda Hardware Products Co., Ltd., Shenzhen (CN)

(72) Inventor: Lijun Zhang, Shenzhen (CN)

(73) Assignee: Shenzhen Jiangda Hardware Products Co., Ltd., Shenzhen (CN)

( * ) Notice: Subject to any disclaimer, the term of this patent is extended or adjusted under 35 U.S.C. 154(b) by 0 days.

(21) Appl. No.: 18/188,473

(22) Filed: Mar. 23, 2023

(30) Foreign Application Priority Data

Feb. 15, 2023 (CN) ..... 202320222422.8
Mar. 10, 2023 (CN) ..... 202320524177.6

(51) Int. Cl.
*A45C 1/06* (2006.01)
*A45C 13/00* (2006.01)

(52) U.S. Cl.
CPC ..... *A45C 1/06* (2013.01); *A45C 13/007* (2013.01); *A45C 2001/062* (2013.01); *A45C 2001/065* (2013.01); *A45C 2001/067* (2013.01)

(58) Field of Classification Search
CPC ... A45C 1/06; A45C 13/007; A45C 2001/062; A45C 2001/065; A45C 2001/067
See application file for complete search history.

(56) References Cited

U.S. PATENT DOCUMENTS

| | | | | |
|---|---|---|---|---|
| 11,284,689 | B1 | 3/2022 | Duncan | |
| 2013/0276943 | A1* | 10/2013 | Minn | A45C 1/06 150/137 |
| 2015/0083289 | A1* | 3/2015 | Johnson | A45C 1/06 150/144 |
| 2017/0135452 | A1* | 5/2017 | Kane | A45C 1/08 |
| 2020/0305564 | A1* | 10/2020 | Myers | A45C 1/06 |

* cited by examiner

*Primary Examiner* — Sue A Weaver
(74) *Attorney, Agent, or Firm* — Andrew C. Cheng

(57) ABSTRACT

The present invention relates to a card holder including a card holder body. The card holder body includes a first card clamping plate and a second card clamping plate, and a connecting device is arranged between the first card clamping plate and the second card clamping plate to connect the first card clamping plate and the second card clamping plate; the connecting device causes a relative displacement in a vertical direction between the first card clamping plate and the second card clamping plate to form a freely retractable internal space, thereby accommodating a plurality of cards; and the connecting device includes two connecting members rotationally connected through a shaft, and a first elastic member connected with each connecting member. The first elastic member provides an elastic restoring force for the first card clamping plate and the second card clamping plate to respectively restore to an initial position.

13 Claims, 5 Drawing Sheets

CARD HOLDER

FIELD OF THE INVENTION

The present invention relates to the technical field of card holders, in particular to a durable card holder with a simple structure and convenient carrying.

BACKGROUND OF THE INVENTION

With the accumulation of metal card holders in the market for a long time, users have gradually raised their requirements for product details. With the popularity of online cash payment, people are carrying less and less cash, so they don't need the function of carrying a lot of cash. They also need the function of putting a small amount of money and bills in metal card holders, and the size of wallets and card holders tends to be small and portable, etc. A metal card holder in the prior art is used for placing cards such as bank cards, business cards and bills.

Modern people have to deal with cards more or less, such as various bank cards, supermarket cards, shopping cards and membership cards. If so many cards are not properly stored, unnecessary troubles are often caused. Card holders are just for managing so many cards, which can be said to be a product of modern economy. There are generally two forms of card holders, one is a page-turning card holder, just like a page; and the other is a rotary card holder. In terms of material, leather is the most common, just like a wallet, which is suitable for carrying around.

When there are too many cards in the card holder, it is not very convenient to insert and take cards; and in the process of carrying the card holder, the cards are easy to fall out of the card holder due to bumps on the way, resulting in unnecessary troubles.

SUMMARY OF THE INVENTION

An object of the present invention is to solve the above technical problems and thus provide a novel card holder which is simple and convenient to carry. Through a connecting device, a first card holder plate and a second card holder plate are elastically displaced, and an internal space can freely expand and contract, forming a space for accommodating cards and clamping the cards, and meeting the function of placing cards of different sizes.

The technical problem of the present invention is realized by the following technical scheme: a card holder is provided. The card holder includes a card holder body comprising a first card clamping plate and a second card clamping plate; and a connecting device be configured to arrange between the first card clamping plate and the second card clamping plate and used for connecting the first card clamping plate and the second card clamping plate, wherein the connecting device comprises two connecting members rotationally connected through a shaft and a first elastic member connected with each connecting member; the connecting device causes a variable displacement in a vertical direction between the first card clamping plate and the second card clamping plate to form a freely retractable internal space, thereby accommodating a plurality of cards; and wherein the first elastic member provides an elastic restoring force for the first card clamping plate and the second card clamping plate to respectively restore to an initial position.

Preferably, the first elastic member is sleeved on each connecting member, one end of each first elastic member is arranged in an installation groove provided in the first card clamping plate or the second card clamping plate, and the other end of the first elastic member is movably or fixedly connected with each connecting member.

Preferably, the connecting device further comprises a second elastic member sleeved on the connecting member, one end of the second elastic member is arranged in the installation groove of the first card clamping plate or the second card clamping plate, and the other end of the second elastic member abuts against an inner side of the installation groove, and the second elastic element provides an elastic restoring force for the connecting member to move outwards in a horizontal direction.

Preferably, the first elastic member is a torsion spring.

Preferably, at least one connecting device is arranged on each of the opposite sides of the first card clamping plate and the second card clamping plate.

Preferably, a blocking device for blocking the card from falling off is arranged on the first card clamping plate and the second card clamping plate.

Preferably, the blocking device comprises two connecting members which are connected rotatably, one end of each connecting member is respectively installed on the first card clamping plate and the second card clamping plate; and the other end of each connecting member is connected with each other through a rotating shaft.

The technical problem of the present invention is realized by the following technical scheme: a card holder is provided. The card holder includes:

a first card clamping plate;

a second card clamping plate structurally symmetrical with the first card clamping plate; and at least one connecting device being configured to arrange between the first card clamping plate and the second card clamping plate to connect the first card clamping plate and the second card clamping plate, wherein each connecting device comprises two connecting members rotationally connected through a shaft, and a first elastic member providing an elastic restoring force for the first card clamping plate and the second card clamping plate to respectively restore to an initial position;

wherein the at least one connecting device causes a relative displacement in a vertical direction between the first card clamping plate and the second card clamping plate to form a freely retractable internal space, thereby accommodating at least one card; and wherein the two connecting members of each connecting device are respectively arranged on the first card clamping plate and the second card clamping plate.

Preferably, each connecting device further comprises a second elastic element sleeved on each connecting member, and the second elastic element provides an elastic restoring force for each connecting member after moving outward in a horizontal direction.

Preferably, the first elastic member is sleeved on each connecting member, one end of the first elastic member is arranged in an installation groove provided in the first card clamping plate or the second card clamping plate, and the other end of the first elastic member is movably or fixedly connected with each connecting member.

The technical problem of the present invention is realized by the following technical scheme: a card holder is provided. The card holder includes:

a first card clamping plate;

a second card clamping plate being opposite to the first card clamping plate; two connecting devices arranged between the first card clamping plate and the second card clamping plate and arranged on opposite sides of the first card clamping plate and the second card clamping plate, wherein each connecting device comprises two connecting members being rotationally connected through a shaft and a first elastic member respectively mounted to each connecting member, and the two connecting members rotate around the shaft to be unfolded to produce a movement in a vertical direction of the first card clamping plate relative to the second card clamping plate, to thereby form a freely retractable space used for accommodating at least one card; and wherein the two connecting members are respectively arranged on the first card clamping plate and the second card clamping plate; and the first elastic member is configured to provide an elastic restoring force for the first card clamping plate and the second card clamping plate to respectively restore to an initial position.

Preferably, each connecting device further comprises a second elastic element sleeved on the connecting member, and the second elastic element provides an elastic restoring force for the connecting member after moving outward in a horizontal direction.

Preferably, each first elastic member is sleeved on each connecting member, one end of each first elastic member is arranged in an installation groove provided in the first card clamping plate or the second card clamping plate, and the other end of each first elastic member is movably or fixedly connected with each connecting member.

The present invention has the beneficial effects in that:

(1) the card holder has a simple structure and small occupied space, and is convenient to operate and durable; and (2) through the connecting devices and the elastic displacement occurring between the first card holder plate and the second card holder plate, the internal space can freely expand and contract, forming a reset clamping pocket for holding cards, and meeting the function of storing cards with different sizes and not falling easily.

DETAILED DESCRIPTIONS OF THE INVENTION

The technical solutions in the embodiments of the present invention will be described clearly and completely in conjunction with the accompanying drawings in the embodiments of the present invention. Apparently, the described embodiments are merely some embodiments, rather than all embodiments, of the present invention. Based on the embodiments of the present invention, all other embodiments derived by a person of ordinary skill in the art without creative efforts shall fall within the protection scope of the present invention.

Figure 1:
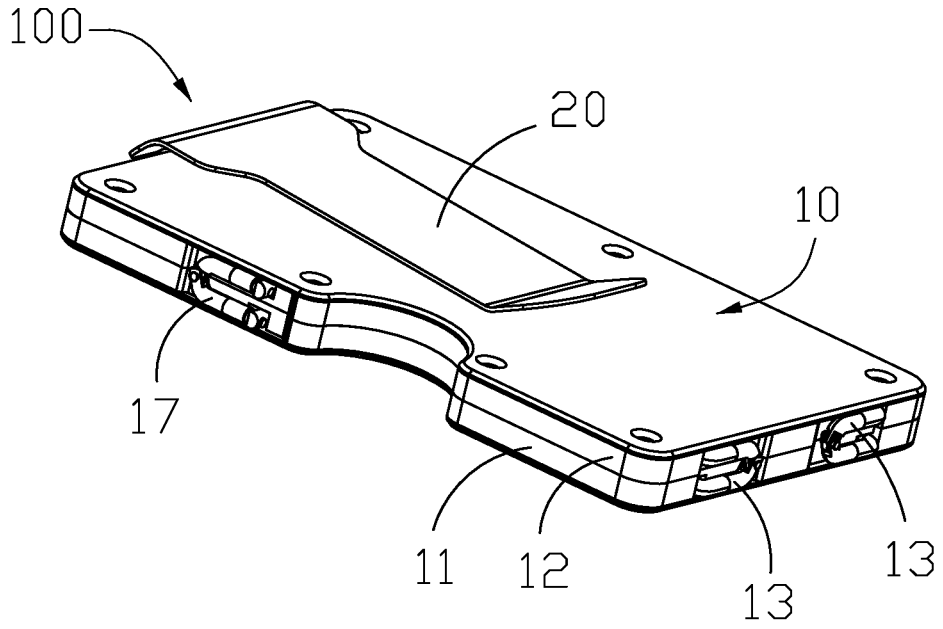
FIG. 1 is a schematic structural diagram of a card holder of the present invention.
Figure 2:
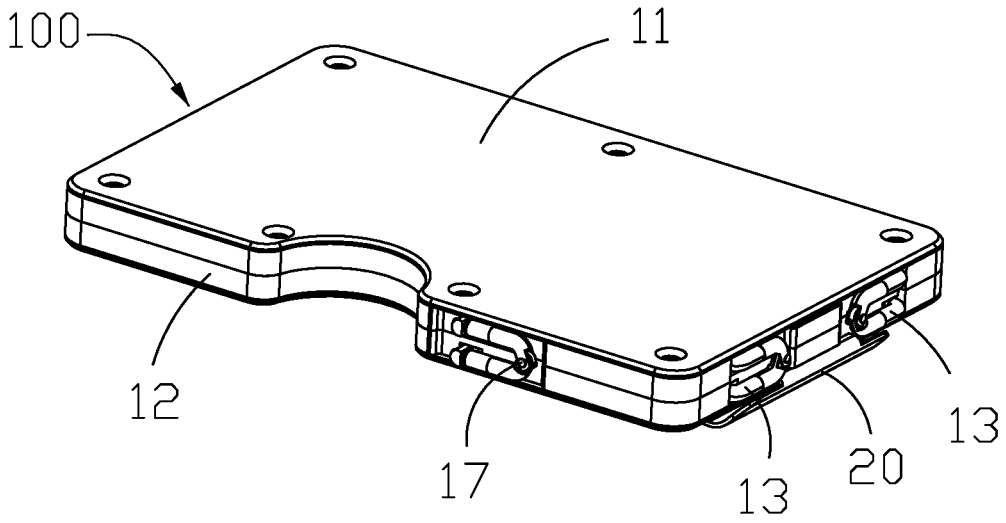
FIG. 2 is another structural schematic diagram of the card holder of the present invention.
Figure 3:
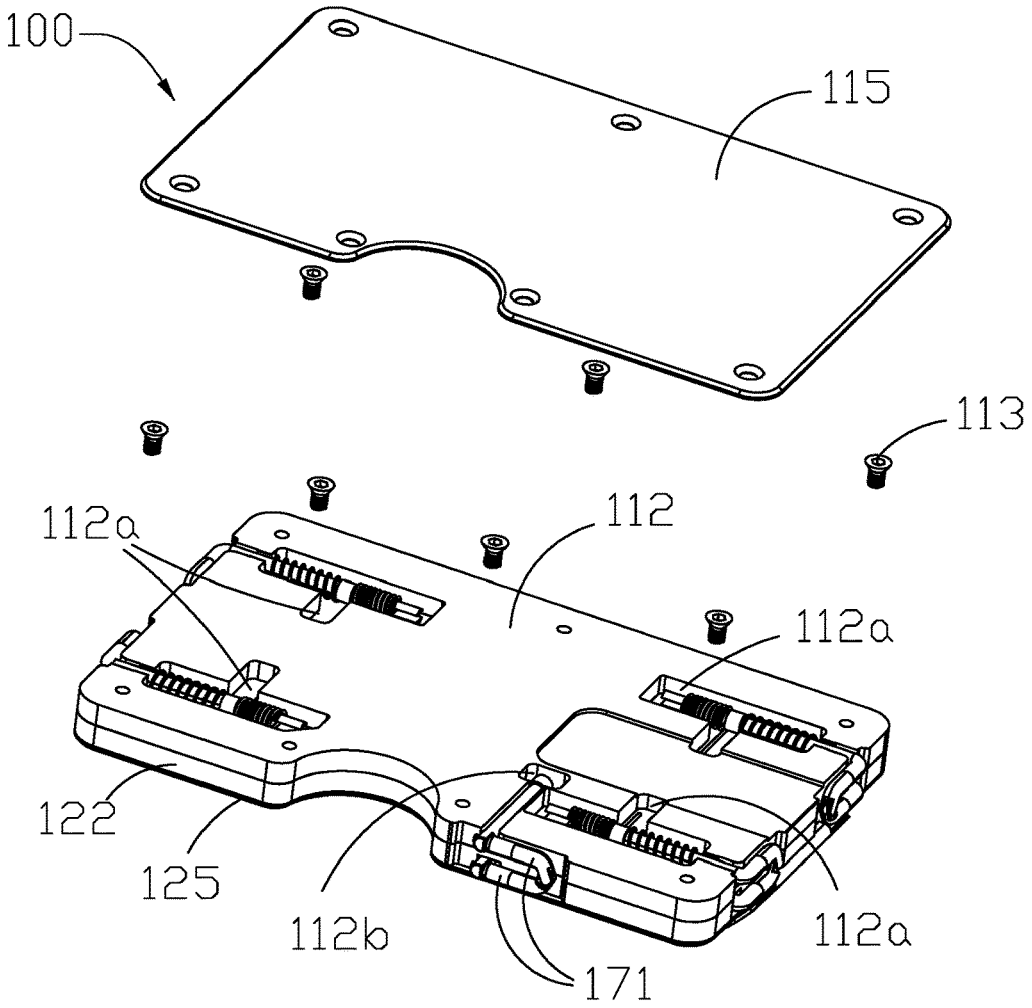
FIG. 3 is an exploded view of the card holder of the present invention.

With reference to FIG. 1 to FIG. 3, the present application provides a card holder 100 which is used for carrying a plurality of cards 200 simply and conveniently, and includes a card holder body 10 and a fixing clip 20 installed on the card holder body 10, wherein the fixing clip 20 is used for fixing the card holder body 10 on an object such as a belt or a shoulder strap for carrying or for entraining paper money. The card holder body 10 includes a first card clamping plate 11, and a second card clamping plate 12 symmetrical to the first card clamping plate 11, wherein the first card clamping plate 11 and the second card clamping plate 12 are connected by four connecting devices 13 with the same structure, and an elastic pressure is generated between the first card clamping plate 11 and the second card clamping plate 12 in an initial state before use. The first card clamping plate 11 and the second card clamping plate 12 are displaced in the vertical direction under the action of an external pulling force, and the internal space between the first card clamping plate 11 and the second card clamping plate 12 can be freely expanded to form a pocket 15 (or also referred to as a space for accommodating a plurality of cards) with an adjustable space for accommodating a plurality of cards 200. Under the action of releasing the external pulling force, the first card clamping plate 11 and the second card clamping plate 12 return to the initial positions under the action of the elastic restoring force, that is, the first card clamping plate 11 and the second card clamping plate 12 are pressed against each other.

Through the connecting devices 13, the first card clamping plate 11 and the second card clamping plate 12 are elastically displaced in the vertical direction, and the internal space can freely expand and contract, thus forming a pocket 15 capable of holding a plurality of cards 200, and meeting the function of placing cards of different sizes and numbers. Specifically, in this embodiment, only two connecting devices 13 are provided on opposite sides between the first card clamping plate 11 and the second card clamping plate 12. It can be understood that only one connecting device 13 can be provided on each side, or three or more connecting devices 13 can be provided, depending on needs and actual conditions. For the sake of beauty, the outermost end of the connecting device 13 is accommodated in a concave space, and the outermost end of the connecting device 13 is in line with the outermost edges of the first card clamping plate 11 and the second card clamping plate 12.

Further, in order to locate a plurality of cards 200 and prevent these cards 200 from slipping off, a blocking device 17 for preventing the plurality of cards 200 from slipping off is provided between the first card clamping plate 11 and the second card clamping plate 12. The blocking device 17 includes two connecting members 171 which are connected rotatably, one end of each connecting member 171 is respectively installed in an installation groove 112*b* of the first card clamping plate 11 and an installation groove (not shown since the first card clamping plate 11 and the second card clamping plate 12 are structurally symmetrical) of the second card clamping plate 12: and the other end of each connecting member 171 is connected by a rotating shaft. The blocking device 17 may not be limited to the above blocking method, but may also be an elastic element accommodated in a groove in the first card clamping plate 11 and the second card clamping plate 12 or an elastic element connecting the first card clamping plate 11 and the second card clamping plate 12. The elastic element is any one of a telescopic spring, an elastomer, an elastic band, an elastic band, an elastic sheet, a corrugated tube or a spring tube. In short, any structure that can play a blocking role is included in the conception of the present application.

Referring to FIG. 3, the first card clamping plate 11 includes a base plate 112 and a mounting plate 115 fixed on the base plate 112 by a plurality of fixing members 113 (such as screws). The second card clamping plate 12 includes a base plate 122 and a mounting plate 125 fixed on the base plate 122 by a plurality of fixing members 113 (such as screws). The inside surface of each of the first card clamping plate 11 and the second card clamping plate 12 is provided with four T-shaped installation grooves 112*a* for accommodating a main body of each connecting device 13. The outside surface of each of the first card clamping plate 11 and the second card clamping plate 12 is provided with four installation grooves for accommodating an exposed portion of each connecting device 13.

Figure 4:
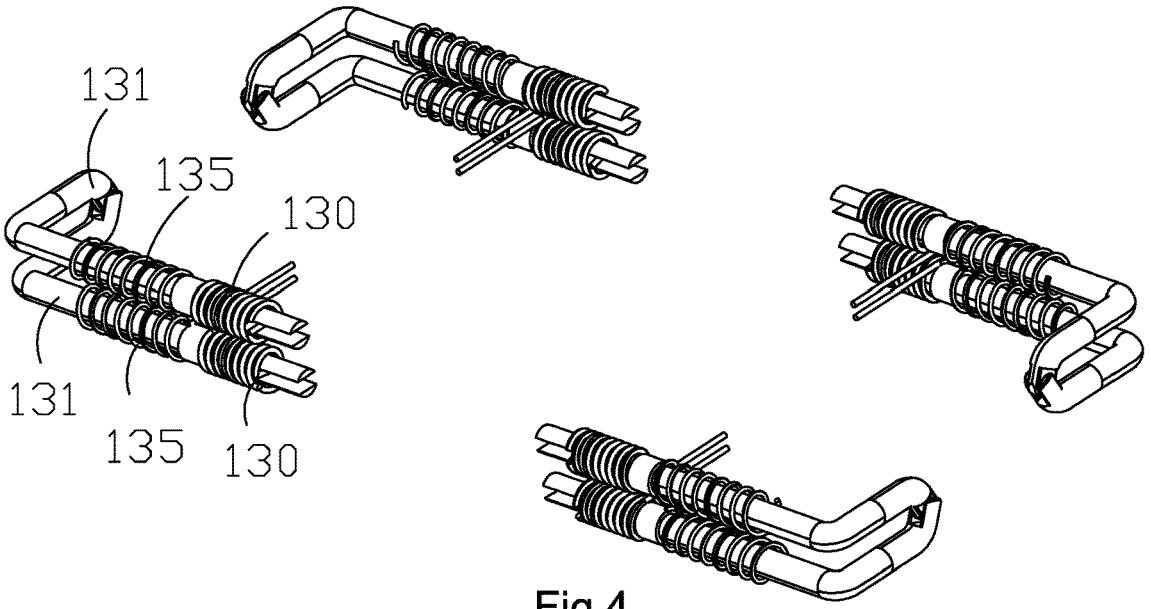
FIG. 4 is a schematic structural diagram of four connecting members of the card holder of the present invention.
Figure 8:
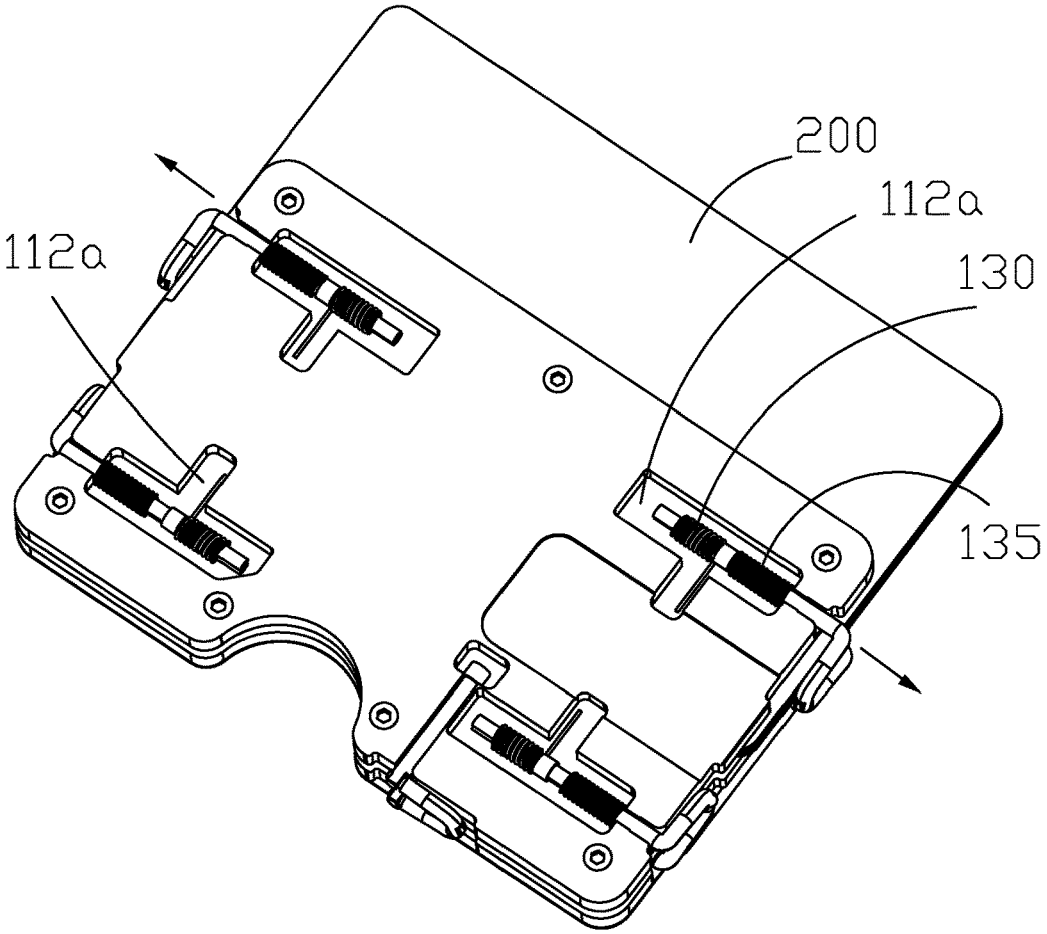
FIG. 8 is a partial schematic structural diagram of the card holder of the present invention after a small number of cards with a slightly larger width are inserted.

Referring to FIG. 4, each connecting device 13 includes a first elastic member 130, and two connecting members 131 connected by a shaft. The first elastic member 130 is sleeved on each connecting member 131, and a free end of the first elastic member 130 is embedded in the T-shaped installation groove 112*a*, and the other end of the first elastic member 130 is movably or fixedly connected with the connecting member 131. In this embodiment, the first elastic member 130 is a torsion spring. In addition, in order to allow the card 200 with a width slightly larger than that of the first card clamping plate 11 and the second card clamping plate 12 to enter the pocket 15, a second elastic member 135 which is also accommodated in the installation groove 112*a* is also sleeved on each connecting member 131. In addition, one end of the second elastic member 135 is positioned on the connecting member 131, and the other end of the second elastic member 135 abuts against the inner side of the installation groove 112*a*. When the card 200 with a slightly larger width is inserted into the pocket 15, two ends of the card 200 press against the connecting member 131, so that the connecting member 131 moves horizontally outward (see an arrow direction in FIG. 8), thus providing an entry space for the card with a slightly larger width. In addition, see FIG. 8, when the card with a slightly larger width is removed from the pocket 15, each connecting member 131 moves horizontally from the outside to an initial position under the action of the elastic restoring force of the second elastic member 135. It can be understood that each connecting member 131 is subjected to an acting force from the second elastic member 135 at the initial position.

Figure 5:
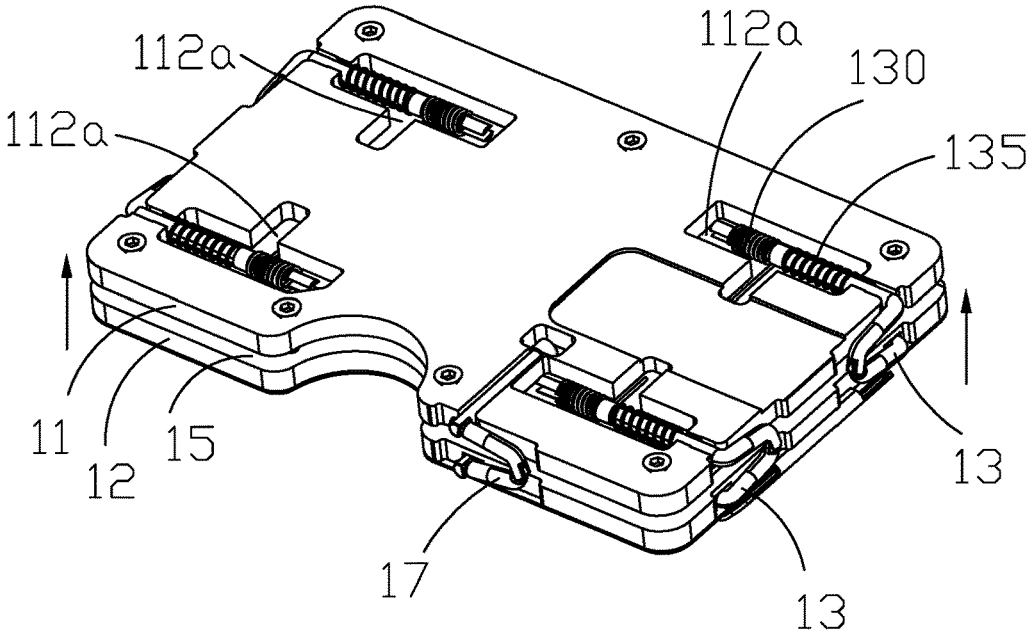
FIG. 5 is a partial schematic structural diagram of the card holder of the present invention before a small number of cards are inserted.
Figure 6:
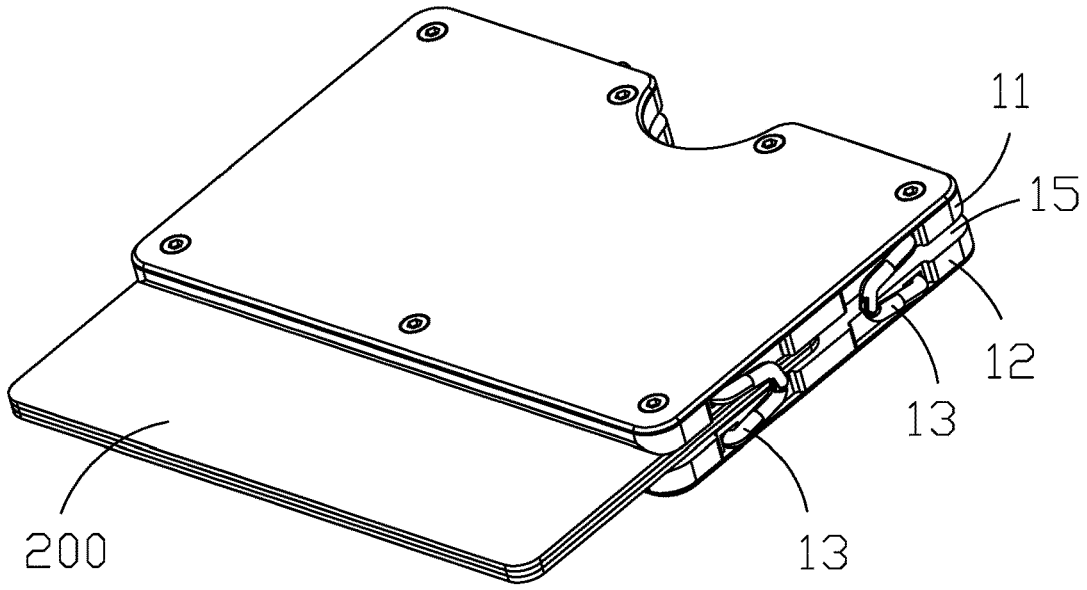
FIG. 6 is a schematic structural diagram of the card holder of the present invention in the process of inserting a small number of cards.
Figure 7:
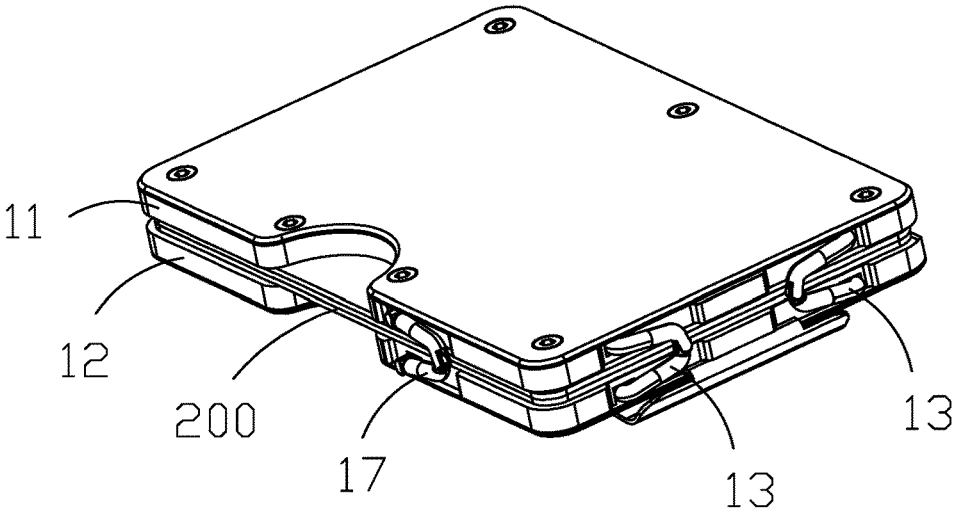
FIG. 7 is a schematic structural diagram of the card holder of the present invention after a small number of cards are inserted.

As shown in FIG. 5 to FIG. 7, at the initial position, the first card clamping plate 11 and the second card clamping plate 12 of the card holder 100 are pressed against each other under the elastic force of the first elastic member 130 (such as the torsion spring). That is, there is a small relative acting force between the first card clamping plate 11 and the second card clamping plate 12. When one or more cards 200 are inserted into the card holder 100, the first card clamping plate 11 and the second card clamping plate 12 are relatively displaced in the vertical direction under the action of an external pulling force (see an arrow direction in FIG. 5). At the same time, the two connecting members 131 of each connecting device 13 stretch and rotate through a shaft, and the two connecting members 171 of the blocking device 17 stretch and rotate through a shaft to block the cards 200 from falling off. An accommodation space (or referred to as the pocket 15) for accommodating a plurality of cards 200 is formed between the first card clamping plate 11 and the second card clamping plate 12. After these cards 200 are well placed, the external pulling force is released, and the first card clamping plate 11 and the second card clamping plate 12 of the card holder 100 are pressed against the cards 200 under the elastic force of the first elastic member 130 (such as the torsion spring). At this time, there is a large relative acting force (or a clamping force) between the first card clamping plate 11 and the second card clamping plate 12, so that the cards 200 are firmly clamped without detachment.

Figure 9:
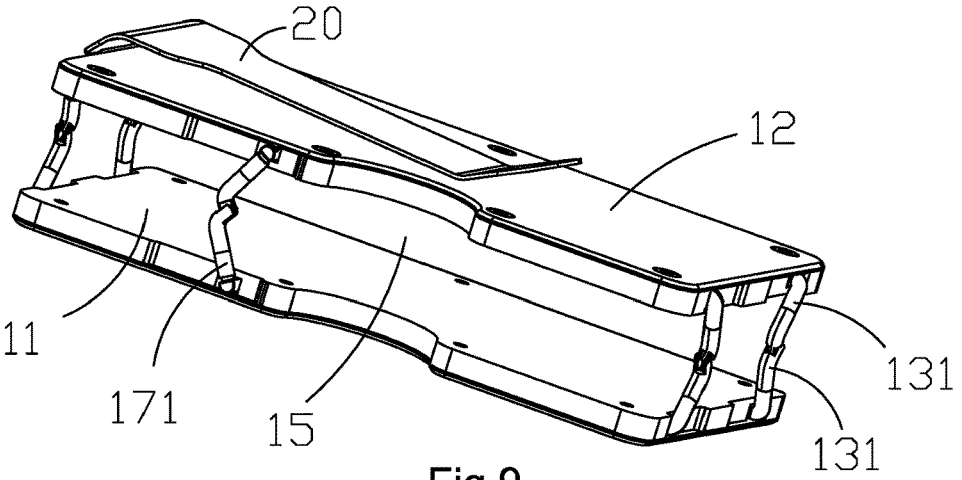
FIG. 9 is a schematic structural diagram of the card holder of the present invention before a maximum number of cards are inserted.
Figure 10:
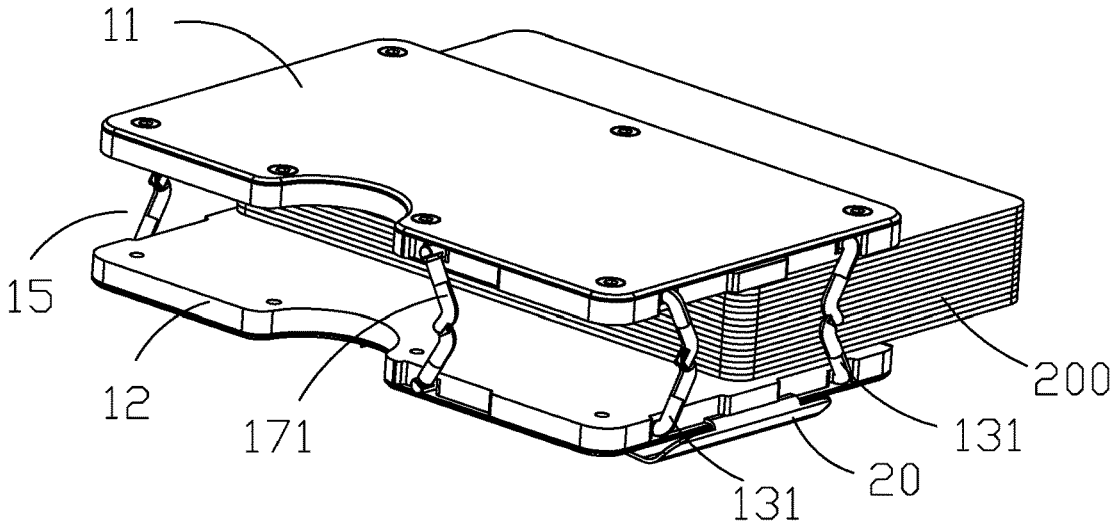
FIG. 10 is a schematic structural diagram of the card holder of the present invention in the process of inserting the maximum number of cards.
Figure 11:
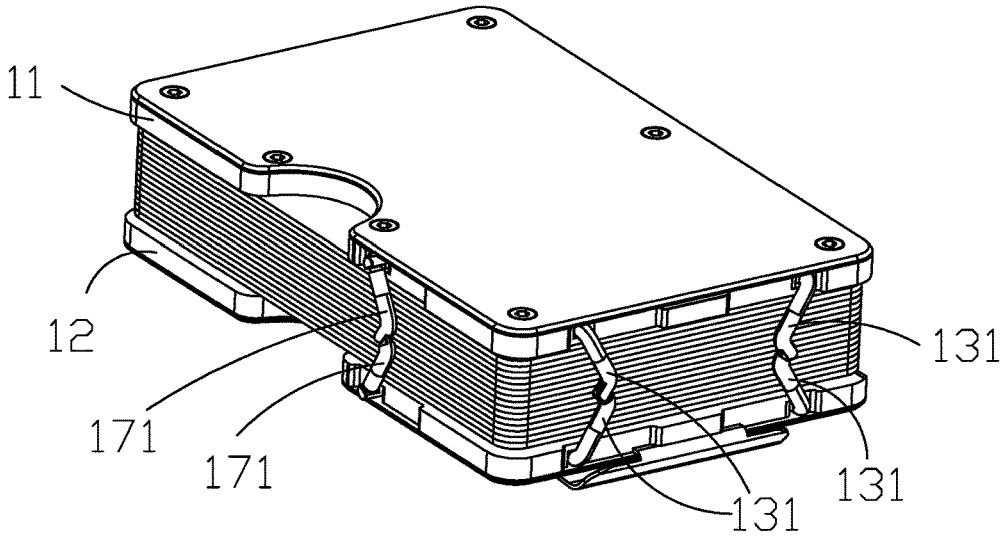
FIG. 11 is a schematic structural diagram of the card holder of the present invention after the maximum number of cards are inserted.

Referring to FIG. 9 to FIG. 11, FIG. 9 is a schematic structural diagram of the card holder 100 before the maximum number of cards 200 are inserted. In FIG. 9, a distance between the first card clamping plate 11 and the second card clamping plate 12 is the largest. That is, in this state, a stretching angle of the two connecting members 131 of the connecting device 13 are the largest, and a stretching angle of the two connecting members 171 of the blocking device 17 is also the largest. At the same time, the elastic restoring force of the first card clamping plate 11 and the second card clamping plate 12 of the card holder 100 on the first elastic member 130 (such as the torsion spring) is also the strongest, that is, the relative acting force between the first card clamping plate 11 and the second card clamping plate 12 is also the strongest (a clamping force is the largest). In this way, the maximum number of cards 200 are firmly clamped between the first card clamping plate 11 and the second card clamping plate 12, so that they are not easy to fall off.

According to the present invention, the first elastic member 130 drives the connecting member 131 through the connecting device 13 to drive the vertical elastic displacement between the first card clamping plate 11 and the second card clamping plate 12, so that the cards accommodated in the internal space between the first card clamping plate 11 and the second card clamping plate are clamped, which is convenient for users to take and put cards simply and conveniently; and the blocking device 17 is arranged to prevent the cards 200 from falling out of the pocket 15, which is beneficial to preventing the card holder from falling off. Therefore, the card holder is simple in structure and convenient to use. Further, the first card clamping plate 11 and the second card clamping plate 12 are made of metal material, for example, aluminum or aluminum alloy material, therefore, the car holder is not easily damaged and very durable.

It should be noted that the card holder embodiments described above are merely illustrative, wherein the units described as separate components may or may not be physically separated. Those of ordinary skill in the art can understand and implement the present invention, without paying any creative work.

The above description is only preferred embodiments of the present invention, and it should be noted that those of ordinary skill in the art may also make several improvements and modifications without departing from the principles of the present invention, which should be considered as the protection scope of the present invention.

The invention claimed is:

1. A card holder comprising:

a card holder body comprising a first card clamping plate and a second card clamping plate; and a connecting device be configured to arrange between the first card clamping plate and the second card clamping plate and used for connecting the first card clamping plate and the second card clamping plate, wherein the connecting device comprises two connecting members rotationally connected with each other and a first elastic member connected with each connecting member, and one of the two connecting members is partially accommodated in the first card clamping plate and the other of the two connecting members is partially accommodated in the second card clamping plate; a relative rotation of the two connecting members of the connecting device causes a variable displacement in a vertical direction between the first card clamping plate and the second card clamping plate to form a freely retractable internal space, thereby accommodating a plurality of cards; and wherein the first elastic member is a torsion spring and sleeved on each connecting member, and the torsion spring provides an elastic restoring force for the first card clamping plate and the second card clamping plate to respectively restore to an initial position.

2. The card holder according to claim 1, wherein one end of each first elastic member is arranged in an installation groove provided in the first card clamping plate or the second card clamping plate, and the other end of the first elastic member is movably or fixedly connected with each connecting member.

3. The card holder according to claim 1, wherein the connecting device further comprises a second elastic member sleeved on the connecting member, one end of the second elastic member is arranged in the installation groove of the first card clamping plate or the second card clamping plate, and the other end of the second elastic member abuts against an inner side of the installation groove, and the second elastic element provides an elastic restoring force for the connecting member to move outwards in a horizontal direction.

4. The card holder according to claim 1, wherein at least one connecting device is arranged on each of the opposite sides of the first card clamping plate and the second card clamping plate.

5. The card holder according to claim 1, wherein a blocking device for blocking the card from falling off is arranged on the first card clamping plate and the second card clamping plate.

6. The card holder according to claim 5, wherein the blocking device comprises two connecting members which are connected rotatably, one end of each connecting member is respectively installed on the first card clamping plate and the second card clamping plate; and the other end of each connecting member is rotatably connected with each other.

7. A card holder comprising:

a first card clamping plate;

a second card clamping plate structurally symmetrical with the first card clamping plate; and at least one connecting device being configured to arrange between the first card clamping plate and the second card clamping plate to connect the first card clamping plate and the second card clamping plate, wherein each connecting device comprises two connecting members rotationally connected with each other, and a first elastic member sleeved on each connecting member and providing an elastic restoring force for the first card clamping plate and the second card clamping plate to respectively restore to an initial position, wherein the two connecting members of each connecting device are respectively arranged on the first card clamping plate and the second card clamping plate, and the first elastic member is a torsion spring;

wherein when an external force causes a relative rotation of the two connecting members of each connecting device, the first card clamping plate and the second card clamping plate are respectively pushed away by rotation of each connecting member, each first elastic member sleeved on each connecting member is activated and a relative movement in a vertical direction between the first card clamping plate and the second card clamping plate is produced to form a freely retractable accommodation space, thereby accommodating at least one card.

8. The card holder according to claim 7, wherein each connecting device further comprises a second elastic element sleeved on each connecting member, and the second elastic element provides an elastic restoring force for each connecting member after moving outward in a horizontal direction.

9. The card holder according to claim 7, wherein one end of the first elastic member is arranged in an installation groove provided in the first card clamping plate or the second card clamping plate, and the other end of the first elastic member is movably or fixedly connected with each connecting member.

10. A card holder comprising:

a first card clamping plate;

a second card clamping plate being opposite to the first card clamping plate;

two connecting devices arranged between the first card clamping plate and the second card clamping plate and arranged on opposite sides of the first card clamping plate and the second card clamping plate, wherein each connecting device comprises two connecting members being rotationally connected with each other and a first elastic member respectively mounted to each connecting member, the two connecting members are respectively arranged on the first card clamping plate and the second card clamping plate, and wherein the two connecting members rotate each other to be unfolded to produce a movement in a vertical direction of the first card clamping plate relative to the second card clamping plate, to thereby form a freely retractable space used for accommodating at least one card, and the first elastic member is continuously compressed; and the first elastic member is configured to provide an elastic restoring force for the first card clamping plate, each connecting member and the second card clamping plate to respectively restore to an initial position.

11. The card holder according to claim 10, wherein each connecting device further comprises a second elastic element sleeved on the connecting member, and the second elastic element provides an elastic restoring force for the connecting member after moving outward in a horizontal direction.

12. The card holder according to claim 10 wherein each first elastic member is sleeved on each connecting member, one end of each first elastic member is arranged in an installation groove provided in the first card clamping plate or the second card clamping plate, and the other end of each first elastic member is movably or fixedly connected with each connecting member.

13. The card holder according to claim 10, wherein the first elastic member is a torsion spring.

* * * * *